US009003573B2

(12) United States Patent
Erman

(10) Patent No.: US 9,003,573 B2
(45) Date of Patent: Apr. 14, 2015

(54) TOILET SEAT LIFTER

(75) Inventor: Richard L. Erman, Phoenix, AZ (US)

(73) Assignee: Griffin-Erman LLC, Phoenix, AZ (US)

( * ) Notice: Subject to any disclaimer, the term of this patent is extended or adjusted under 35 U.S.C. 154(b) by 653 days.

(21) Appl. No.: 13/343,925

(22) Filed: Jan. 5, 2012

(65) Prior Publication Data

US 2013/0174336 A1 Jul. 11, 2013

(51) Int. Cl.
*A47K 13/10* (2006.01)

(52) U.S. Cl.
CPC ..... *A47K 13/10* (2013.01)

(58) Field of Classification Search
CPC ..... A47K 13/10
USPC ..... 4/246.1–246.5
See application file for complete search history.

(56) References Cited

U.S. PATENT DOCUMENTS

| | | | | |
|---|---|---|---|---|
| 1,529,656 A | | 3/1925 | Kornhauser | |
| 1,681,277 A | * | 8/1928 | Booth | 4/236 |
| 2,352,133 A | | 6/1944 | Sperzel et al. | |
| 2,812,522 A | | 11/1957 | Wilson | |
| 3,414,911 A | | 12/1968 | Enlow | |
| 4,817,242 A | | 4/1989 | Rapp | |
| 4,965,890 A | * | 10/1990 | Fischer | 4/240 |
| 5,341,518 A | | 8/1994 | Uhl | |
| 5,642,532 A | | 7/1997 | Morant | |
| 6,012,180 A | | 1/2000 | Williams | |
| 6,230,335 B1 | | 5/2001 | Miller | |
| 2007/0192949 A1 | | 8/2007 | Pan et al. | |

* cited by examiner

*Primary Examiner* — Lori Baker
(74) *Attorney, Agent, or Firm* — Cahill Glazer PLC

(57) ABSTRACT

A toilet seat lifter for raising a toilet seat when not in use includes a base, a threaded shaft extending downwardly therefrom to secure the base to a mounting surface of a toilet bowl, a cylindrical body supported by the base, a hinge pin extending from an end of the cylindrical body for pivotally supporting the toilet seat, and a torsion spring extending around and supported by the cylindrical body. One end of the torsion spring engages the base, and the other end engages the bottom of the toilet seat to bias the toilet seat upwardly away from the bowl. The base and cylindrical body are preferably integrally formed as a single unit. The base preferably includes an upper plateau for being engaged by one end of the torsion spring.

17 Claims, 4 Drawing Sheets

TOILET SEAT LIFTER

BACKGROUND OF THE INVENTION

1. Field of the Invention

The present invention relates generally to apparatus for raising toilet seats, and more particularly, to an economical, and easily-installed apparatus for raising commercial toilet seats in public and/or semi-public restrooms.

2. Description of the Relevant Art

Commercial toilets generally include a floor-mounted, or wall-mounted, toilet bowl, along with a toilet seat hinged to the rear of the bowl. The toilet seat can assume a lowered position resting against the upper rim of the bowl, or a raised position extending upwardly away from the bowl. Women, for the most part, leave the toilet seat in its lowered position at all times, whether they are using the toilet to urinate or defecate. Men, however, generally lift the toilet seat to its raised position when urinating, while lowering the toilet seat during defecation. Often, men are forgetful, or just plain lazy, and leave the toilet seat in its lowered position while urinating, hoping to avoid contact between the urine stream and the seat. Young boys likewise do not bother to raise the seat before urinating, and do not exercise particular care to avoid wetting the seat.

Many commercial toilet seats have an open front portion; in that case, the toilet seat is somewhat U-shaped, rather than extending fully around the toilet bowl rim, leaving the front portion of the upper rim of the bowl exposed. While this design tends to reduce the frequency with which toilet seats become soiled with urine, "wet" toilet seats are a common sight in public restrooms. While those men who neglect to raise the seat may have the best of intentions, accidents happen—apparently often.

Many people believe that they can contract dangerous diseases by sitting on soiled toilet seats. Others simply abhor the thought of sitting on a toilet seat which has been contacted by urine. Accordingly, it is common for owners of public restrooms to provide disposable toilet seat covers for patrons to apply over the toilet seat. While some users appreciate such courtesy, the fact remains that it can be a challenge to position such disposable seat covers properly on the toilet seat and have it remain in place long enough to get seated. In addition, disposable seat covers pose an extra operating expense, both to purchase such items and their dispensers, and to pay maintenance personnel to check and re-stock such dispensers. Still others provide bleach-saturated wipes to sanitize the toilet seat between uses. In that case, the seat must typically be dried afterward, perhaps with a paper towel or some toilet paper.

In most situations, "wet" toilet seats are inconveniences posed by men to other men. However, there are situations in which men and women share the same toilet facilities, as is often true in the case of small businesses. In those cases, women often resent the need to share a bathroom with men who fail to raise the toilet seat before urinating.

Others have disclosed a variety of toilet seat lifting devices for automatically lifting a toilet seat to its raised position. U.S. Pat. No. 1,529,656 to Kornhauser discloses an adjustable spring attachment for raising a toilet seat wherein a spring is coiled about a tubular member. One end of the spring is retained in an adjustable collar, while the other end of the spring extends beneath the toilet seat. The aforementioned tubular member is bolted to a bar adjacent to the hinge supports that pivotally support the toilet seat. The adjustable collar may be used to adjust the tension of the spring to correspond to the weight of the seat.

U.S. Pat. No. 1,681,277 to Booth discloses a spring hinge for urging a toilet seat toward a raised position. A tubular pintel extends fully through the hinged portion of the toilet seat, and a helical torsion spring extends around the pintel. An outer casing portion of the toilet seat extends fully around the pintel and the torsion spring.

U.S. Pat. No. 2,352,133 to Sperzel, et al. also discloses a helical torsion spring for biasing a toilet seat toward a raised position. A hinge rod extends fully across the pivoting portion of the toilet seat. A torsion spring surrounds the hinge rod and extends for most of its length. One end of the torsion spring engages a fixed block secured to a hinge bracket. The opposite end of the torsion spring is connected to an apertured disk fixed to the hinge rod. The tension of the spring is adjusted by selecting one of several apertures in which to engage the end of the torsion spring.

U.S. Pat. No. 2,812,522 to Wilson discloses a toilet seat lifter including a pair of torsion springs and a tension plate. After removing a hinge from the bottom of the toilet seat, a pair of torsion springs are slid over an elongated toilet seat hinge pin. The tension plate is secured to the toilet bowl below the hinge pin by slots that fit around the bolts that secure the hinges to the toilet bowl.

U.S. Pat. No. 3,414,911 to Enlow discloses another form of self-raising toilet seat using a hinge pin of non-circular cross-section for engaging an associated non-circular sleeve provided in the rear portion of the toilet seat. Spring-biased hinge blocks bolt to opposing sides of the toilet bowl and rotatably support the hinge pin. The torsion springs engage the ends of the hinge pin and bias the hinge pin in the rotational direction that raises the toilet seat.

U.S. Pat. No. 4,817,242 to Rapp discloses a toilet seat spring hinge for pivotally attaching a toilet seat to the toilet bowl and for biasing the toilet seat toward its raised position. The disclosed spring hinge has a series of holes formed in one of its hinge plates for receiving screws that secure such hinge plate to the bottom of the toilet seat.

U.S. Pat. No. 4,965,890 to Fisher discloses a spring hinge assembly for toilet seats that bears some similarities to that of the present invention. Fisher's spring hinge assembly includes a body portion having a mounting bolt extending downwardly from the body portion for passing through a mounting hole of the toilet bowl. Fisher's spring hinge assembly further includes a hinge pin secured to the body portion, and which extends laterally from a side wall of the body portion for insertion into the rear portion of the toilet seat. Fisher's spring hinge assembly further includes a helical torsion spring, one end of which contacts the underside of the toilet seat. The opposing end of Fisher's torsion spring, and indeed the majority of the torsion spring itself, is recessed within a notch formed within the side wall of the body portion; the torsion spring surrounds the aforementioned hinge pin.

Fisher's spring hinge assembly poses several disadvantages. First, Fisher's torsion spring must be of relatively small diameter, both because it is supported in part by the toilet seat hinge pin (which passes through the helically-wound portion of such torsion spring), and because such torsion spring must fit within the recess cut into the sidewall of the mounting body. Secondly, an odd-shaped recessed notch must be formed in the side wall of the body portion to receive the torsion spring; the requirement for such odd-shaped recess complicates manufacture, whether a machining process or a molding process is used. Finally, if it is desired to use a pair of such spring hinges (i.e., left-side and right-side) to raise the toilet seat, then separate left- and right-handed body portions must be fabricated. In this regard, Fisher notes, in column 3 of his specification, that " . . . the spring hinges must include a left oriented one used in conjunction with a right oriented one."

U.S. Pat. No. 5,341,518 to Uhl discloses another form of toilet seat lifter, including a pair of torsion springs placed on opposing ends of a toilet seat pivot axle, and wherein a commode lid 17 is also included.

U.S. Pat. No. 5,642,532 to Morant discloses an apparatus for lifting a commode seat, including a helical spring and a mechanism for adjusting the rate at which the seat rises.

U.S. Pat. No. 6,012,180 to Williams discloses a toilet seat lifting device using a pair of leaf springs to raise the seat to an elevated position.

U.S. Pat. No. 6,230,335 to Miller discloses a toilet seat lifting apparatus formed of elastomeric material that deforms when the seat is forced downward, and which straightens back to its original position when the seat is released.

U.S. Patent Application Publication No. US 2007/0192949, published Aug. 23, 2007, to Pan, et al., discloses a self-lifting toilet seat including a hydraulic actuator for adjusting the rate at which the toilet seat is raised by a pair of torsion springs.

The foregoing devices all suffer from one or more disadvantages. For example, some of the aforementioned lifting devices require substantial modification and/or reconstruction of the toilet bowl and/or toilet seat. Others of such devices are relatively bulky, or include components that project from the toilet, posing safety hazards, or inviting tampering by users. Some of the aforementioned lifting devices are complex and relatively expensive. In the case of the spring hinge assembly disclosed in the aforementioned patent to Fisher, the molding of the required bores, tapping of threads, and formation of recesses into the body portion of such assembly is relatively costly.

Accordingly, it is an object of the present invention to provide a toilet seat lifter for raising commercial toilet seats in public and/or semi-public restrooms.

Another object of the present invention is to provide such a toilet seat lifter that is compatible with popular commercial toilet bowls and toilet seats to avoid the need for significant modification thereof.

Yet another object of the present invention is to provide such a toilet seat lifter that can quickly and easily be installed on most toilets already present in existing public restrooms.

Still another object of the present invention is to provide such a toilet seat lifter which is compact and relatively immune from tampering by users.

A further object of the present invention is to provide such a toilet seat lifter that is relatively easy and inexpensive to manufacture.

These and other objects of the invention will become more apparent to those skilled in the art as the description of the present invention proceeds.

SUMMARY OF THE INVENTION

Briefly described, and in accordance with a preferred embodiment thereof, the present invention relates to toilet seat lifter for raising a toilet seat of a toilet when not in use. The toilet includes a bowl having an upper rim, the bowl including a horizontal mounting surface behind the upper rim for attachment of the toilet seat.

The toilet seat lifter includes a base having a bottom surface adapted to rest upon the horizontal mounting surface of the bowl, as well as a shaft having a threaded end extending downwardly from the bottom surface of the base for extending through a hole formed in the horizontal mounting surface of the bowl to secure the base thereto. Preferably, a nut is provided to engage the threaded end of the shaft below the horizontal mounting surface of the bowl. In the preferred embodiment, the base is molded about an end of the shaft during manufacture.

The toilet seat lifter also includes a cylindrical body supported in fixed relationship to the base. The cylindrical body extends about a central longitudinal axis between first and second ends; in the preferred embodiment, the second end of the cylindrical body is rigidly secured to the base; indeed, it is preferred that the base and the cylindrical body be integrally formed from a single portion of plastic material. The central longitudinal axis of the cylindrical body extends substantially horizontally when the base is secured to the horizontal mounting surface of the toilet bowl.

A hinge pin extends from the first end of the cylindrical body generally along its central longitudinal axis for pivotally supporting the toilet seat relative to the horizontal mounting surface of the bowl. In the preferred embodiment, the cylindrical body is molded about an end of the hinge pin. A torsion spring extends around the cylindrical body and is supported thereby. A first end of the torsion spring engages the base, while the second end of the torsion spring engages the underside of the toilet seat. In this manner, the torsion spring biases the toilet seat upwardly away from the bowl until a user pushes the toilet seat downwardly against the rim of the bowl.

Preferably, the base includes a generally-flattened plateau that extends above, and generally parallel to, the bottom surface of the base. The first end of the torsion spring may then engage the generally-flattened plateau of the base. It is also preferred that the cylindrical body extend above the plateau of the base, and being spaced apart from the plateau of the base by a sufficient gap for allowing the torsion spring to slide over the cylindrical body from the first end thereof during manufacture.

Apart from the toilet seat lifter itself, the present invention also contemplates a self-lifting toilet seat assembly, including a toilet seat and at least one lifting device. The toilet seat includes a rear portion for being pivotally secured to the horizontal mounting surface of the toilet bowl. The rear portion of the toilet seat includes first and second opposing bores formed therein for receiving first and second hinge pins. The at least one seat lifting device includes a base having a bottom surface adapted to rest upon the horizontal mounting surface of the bowl, and a threaded shaft extending downwardly from the bottom surface of the base for extending through a hole formed in the horizontal mounting surface of the bowl to secure the base thereto.

The at least one lifting device also includes a cylindrical body that is supported in fixed relationship to the base, extending about a central longitudinal axis between first and second ends. The cylindrical body is oriented so that it extends substantially horizontally when the base is secured to the horizontal mounting surface of the bowl. A hinge pin extends from the first end of the cylindrical body generally along the central longitudinal axis thereof for extending within one of the first and second opposing bores formed in the rear portion of the toilet seat. A torsion spring extends around, and is supported by, the cylindrical body; the first end of the torsion spring engages the base, and its second end engages the bottom surface of the toilet seat for biasing the toilet seat upwardly away from the bowl until a user pushes the toilet seat downwardly against the rim of the bowl. In the preferred embodiment, two of such lifting devices are used, one on each side of the toilet seat.

Once again, in the preferred form of such lifting device, the second end of the cylindrical body is rigidly secured to the base. Preferably, the base and the cylindrical body of the lifting device are integrally formed from a single portion of plastic material. Within one preferred embodiment, a hole is drilled and tapped within the base of the lifting device for threadedly receiving one end of the threaded shaft, and one end of the hinge pin is press-fit into a hole drilled in the cylindrical body. In an alternate embodiment, the base of the lifting device is molded about an end of the threaded shaft, and the cylindrical body is molded about an end of the hinge pin.

DETAILED DESCRIPTION OF THE PREFERRED EMBODIMENT

Figure 1A:
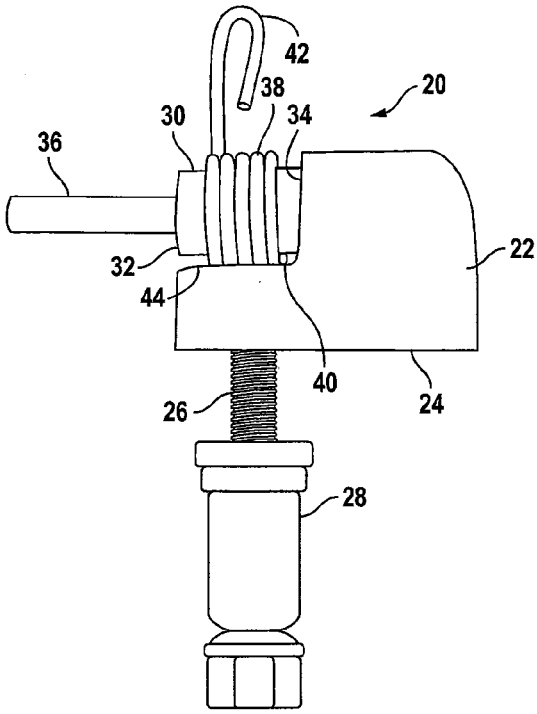
FIG. 1A is a side view of a toilet seat lifting device constructed in accordance with a preferred embodiment of the present invention.
Figure 1B:
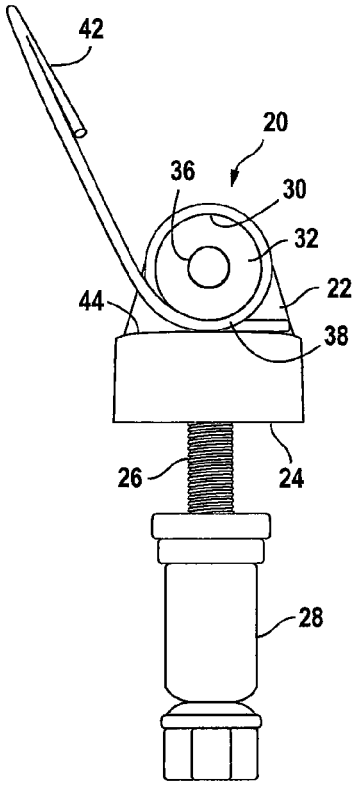
FIG. 1B is a first end view of the toilet seat lifting device shown in FIG. 1A.
Figure 1C:
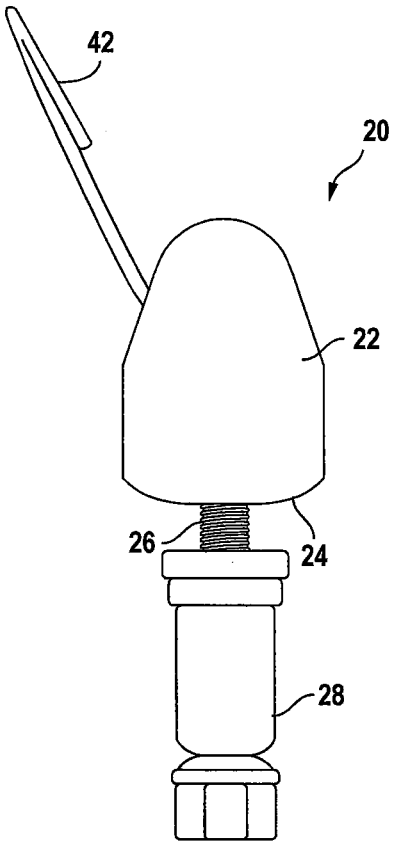
FIG. 1C is a second, opposing end view of the toilet seat lifting device shown in FIGS. 1A and 1B.

A preferred form of toilet seat lifting device, constructed in accordance with the teachings of the present invention, is designated generally in FIGS. 1A, 1B and 1C by reference numeral 20. Lifting device 20 includes a base 22 having a bottom surface 24 that is adapted to rest upon a horizontal mounting surface of a toilet bowl. Shaft 26 extends downwardly from bottom surface 24 of base 22. At least the lower end of shaft 26 is threaded, although it is preferred that the entire shaft 26 is threaded. Shown in FIGS. 1A, 1B, and 1C is a nut 28 including a threaded bore for engaging the lower end of shaft 26. During installation of lifting device 20 upon a toilet, nut 28 is temporarily disengaged from shaft 26; shaft 26 is adapted to extend through a hole formed in the horizontal mounting surface provided near the rear of the toilet bowl to secure the base thereto. Nut 28 is then threaded back over the threaded end of shaft 26, below the horizontal mounting surface of the bowl, and tightened to secure bottom surface 24 of base 22 against the horizontal mounting surface of the toilet bowl.

Lifting device 20 also includes cylindrical body portion 30 supported in fixed relationship to base 22. Cylindrical body portion 30 extends about a central longitudinal axis between a first end 32 and a second end 34. Second end 34 of cylindrical body portion 30 is preferably rigidly secured to base 22. The central longitudinal axis of cylindrical body portion 30 extends substantially parallel to bottom surface 24; thus, the central longitudinal axis of cylindrical body portion 30 extends generally horizontally when base 22 is secured to the horizontal mounting surface of the toilet bowl.

Referring to FIGS. 1A and 1B, hinge pin 36 extends from first end 32 of cylindrical body portion 30, generally coaxial with the central longitudinal axis of cylindrical body 30. Hinge pin 36 is preferably made from a stainless steel rod, and helps to pivotally support a toilet seat relative to the horizontal mounting surface of the toilet bowl.

In a first preferred embodiment, base region 22 is made from a machinable block of hard plastic, such as acetal resin (also commonly referred to as polyoxymethylene, or POM), e.g., the acetal resin sold by DuPont under its registered trademark Delrin®. In such first preferred embodiment, cylindrical body portion 30 is also made from Delrin® acetal resin. In this first preferred embodiment, base 22 and cylindrical body portion 30 are preferably formed to shape from a single, solid portion of such hard plastic which is "milled", e.g., on a digitally automated CNC (computer numerical control) milling machine.

In such first preferred embodiment, the milling process includes drilling a hole in bottom surface 24 of base 22, and tapping a ⅜ inch diameter threaded bore therein for threadedly receiving the upper end of threaded shaft 26 (having an outer diameter of ⅜ inch) therein. During assembly, approximately one-half inch of threaded shaft 26 extends into such threaded bore, while another 1.5 inches of threaded shaft 26 extends below base 22. The milling process further includes drilling a 5/16 inch bore into the center of first end 32 of cylindrical body portion 30; during assembly, one end of hinge pin 36 (preferably of 5/16 inch outer diameter) is press fit into such 5/16 inch bore to a depth of approximately 1.5 inches, leaving another approximately 1.5 inches of hinge pin 36 extending therefrom for engaging the rear portion of the toilet seat.

In an alternate embodiment of the lifting device, base region 22 and cylindrical body portion 30 of lifting device 20 are integrally formed by molding such components as a single piece of plastic material. In this alternate embodiment, base region 22 may advantageously be molded over the upper end of shaft 26 during such molding process, and cylindrical body 30 may advantageously be molded over one end of hinge pin 36 during such molding process.

A torsion spring 38 extends around cylindrical body portion 30. The inner diameter of torsion spring 38 is commensurate with the outer diameter of cylindrical body portion 30, whereby torsion spring 38 may be slid over cylindrical body portion 30 during assembly and is thereafter supported by cylindrical body portion 30. First end 40 of torsion spring 38 engages base 22, while second end 42 of torsion spring 38 is adapted to engage the underside of the toilet seat; if desired, second end 42 may be formed into a loop to more effectively engage the underside of the toilet, and to minimize the likelihood of any injury to maintenance personnel while performing routine cleaning. In this manner, torsion spring 38 operates to bias the toilet seat upwardly away from the toilet bowl until a user pushes the toilet seat downwardly against the rim of the bowl.

Figure 2:
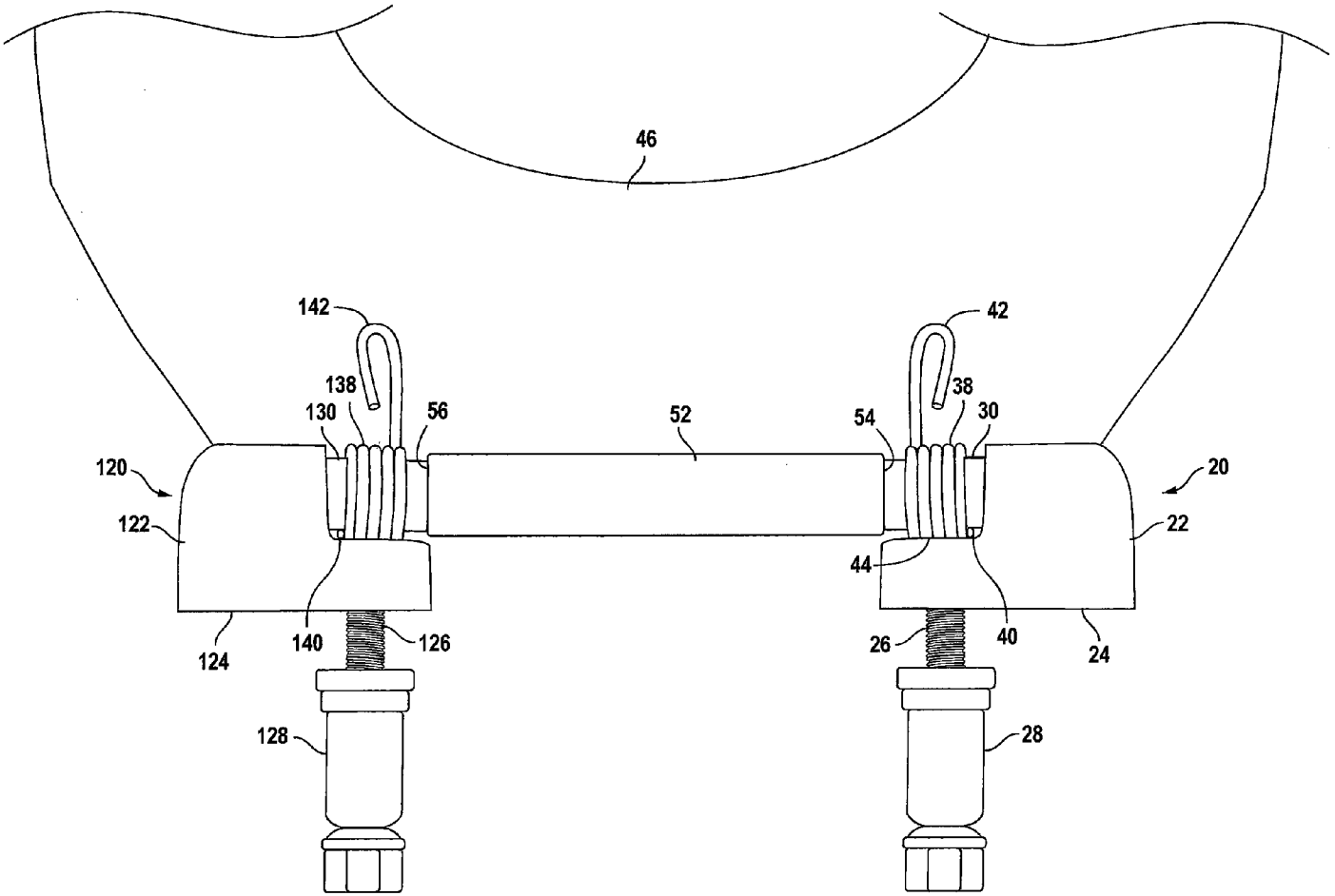
FIG. 2 is an elevational view of a toilet seat lifting assembly including a conventional commercial toilet seat together with two toilet seat lifting devices for pivotally securing the toilet seat to a horizontal mounting surface of a toilet bowl.

Referring briefly to FIG. 2, a second lifting device 120 is also shown. Like the first lifting device 20, second lifting device 120 includes a base 122 having a bottom surface 124. Also like first lifting device 20, second lifting device 120 includes a torsion spring 138 having a first end 140 and a second end 142.

As shown best in FIGS. 1A, 1B and 2, base 22 preferably includes a generally-flattened plateau 44 that extends above, and generally parallel to, bottom surface 24 of base 22. First end 40 of torsion spring 38 may then engage plateau 44 of base 22. Cylindrical body portion 30 extends above plateau 44, and is spaced apart from plateau 44 by a gap sufficient to allow torsion spring 38 to slide over cylindrical body portion 30 from first end 32 during manufacture.

Figure 3:
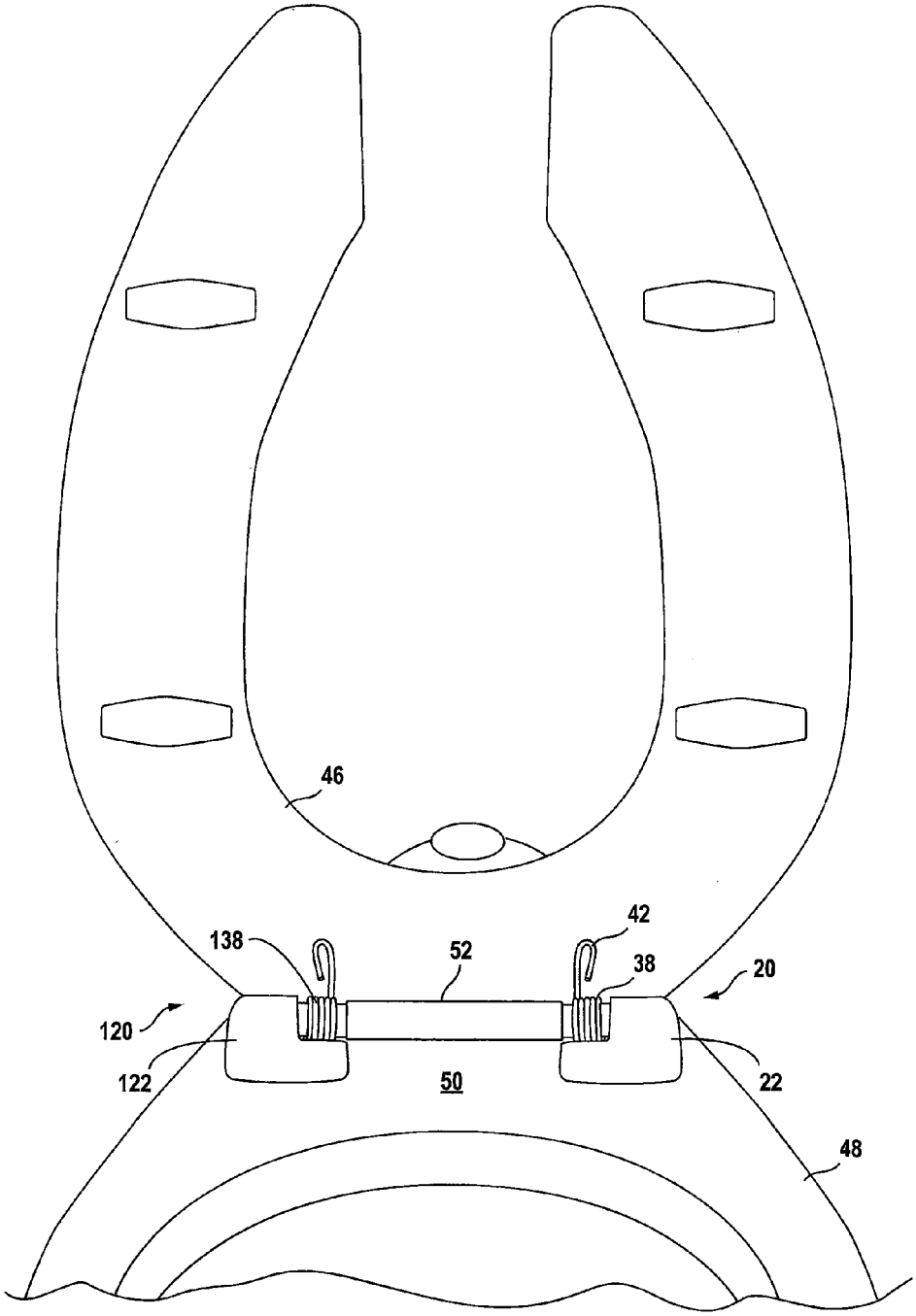
FIG. 3 is a perspective view of the toilet seat lifting assembly shown in FIG. 3 after being mounted to a toilet bowl.

Turning to FIGS. 2 and 3, a self-lifting toilet seat assembly is shown, including toilet seat 46 and at least one lifting device 20. A horizontal mounting surface 50 is provided near the rear of toilet bowl 48 adjacent the upper rim of the bowl. While hidden from view in FIG. 3, a pair of mounting holes are typically provided in horizontal mounting surface 50 to allow for mounting of toilet seat 46 onto toilet bowl 48. In the preferred embodiment, two such lifting devices, 20 and 120, are provided to pivotally support toilet seat 46 upon toilet bowl 48, and to raise toilet seat 46 toward a vertical position except when force is applied by a user to lower seat 46 onto the upper rim top of toilet bowl 48. Second lifting device 120 is a mirror image of first lifting device 20. First and second lifting devices 20 and 120 may be constructed in the same way, from the same components, except that torsion spring 138 is wound in the opposite direction of that for torsion spring 38.

The self-lifting toilet seat assembly shown in FIGS. 2 and 3 includes toilet seat 46 and at least one lifting device 20. Lifting device 20 is secured against horizontal mounting surface 50 by bolt 26 and nut 28. Toilet seat 46 includes a rear tubular portion 52 for being pivotally secured to horizontal mounting surface 50 of toilet bowl 48. Rear tubular portion 52 of toilet seat 46 includes first and second opposing bores formed within its opposing ends 54 and 56 for receiving first and second hinge pins. Hinge pin 36 (see FIG. 1A) of lifting device 20 extends into the bore formed in first end 54 of tubular portion 52 proximate to the rear portion of toilet seat 46. Likewise, the hinge pin (not shown) extending from second lifting device 120 extends into the bore formed in second end 56 of tubular portion 52. Lifting device 120 is then secured against horizontal mounting surface 50 by bolt 126 and nut 128, using a second mounting hole.

Torsion springs 38 and 138 are wound when toilet seat 46 is forced to its lowered position. In contrast, torsion springs 38 and 138 unwind when toilet seat 46 is released, and raise toilet seat 46 back into its initially raised position. In the preferred embodiment, two of such lifting devices, 20 and 120, are used, one on each side of toilet seat 46. However, if torsion spring 38 is strong enough, and toilet seat 46 is light enough, it may be possible to lift toilet seat 46 using the force of only one such torsion spring.

Manufacture of the lifting devices is relatively inexpensive and straightforward. In the first preferred embodiment, base 22 and cylindrical body portion 30 are integrally formed by milling from a single piece of stock. Threaded shaft 26 is secured within the tapped hole formed in bottom surface 24 of base 22, and hinge pin 36 is press-fit into the hole drilled into cylindrical body portion 30. On the other hand, manufacture according to the alternate embodiment includes molding base 22 and cylindrical body portion 30 from a single portion of moldable plastic material. Base 22 and body portion 30 are molded as one integral piece at the same time, and base 22 is preferably molded about the upper end of threaded shaft 26, while cylindrical body 30 is preferably molded about an end of hinge pin 36. Completion of the lifting device assembly merely requires inserting torsion spring 38 over cylindrical body 30.

Existing toilets can be quickly and easily converted to toilets having self-lifting seats simply by removing the existing seat hinges from the toilet, as by unscrewing the mounting nuts and pulling the mounting shafts out of their respective mounting holes. The existing seat hinges can then be withdrawn from the toilet seat. A pair of the above-described lifting devices can then be substituted for the original toilet seat hinges. Now, the toilet seat is not only pivotally secured to the toilet, but it is also caused to raise to a generally vertical position, unless a user affirmatively pushes the seat down to sit upon it.

It will be appreciated that the inner diameter of the helical coil portion of torsion spring 38 is determined by the outer diameter of cylindrical body portion 30, and not by the much smaller diameter of hinge pin 36. Accordingly, the helically-coiled portion of torsion spring 38 may have a relatively large diameter that is independent of the outer diameter of hinge pin 36, but is still firmly-supported by cylindrical body portion 30. It should also be understood that body portion 22, and cylindrical body portion 30, are symmetrical within the end view shown in FIG. 1B; accordingly, the same body portion 22 may be used to form a lifting device on either the left-hand side, or the right-hand side, of the toilet seat. While separate left-hand, and right-hand, torsion springs are required, only the torsion springs differ from each other; the plastic pieces onto which such left-hand, and right-hand, torsion springs are inserted are of exactly the same configuration as each other, thereby minimizing costs of manufacture.

Those skilled in the art will now appreciate that a simple and inexpensive apparatus has been described for automatically lifting the seat of a commercial toilet in public and/or semi-public restrooms when the toilet seat is not in actual use. The above-described toilet seat lifter is compatible with widely-used commercial toilet bowls and toilet seats, avoiding the need for any modifications thereof. Installation is quick and easy, and once installed, the lifting devices are compact and relatively immune from tampering by users. In addition, the lifting devices are of simple and inexpensive construction.

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

I claim:

1. A toilet seat lifter for raising a toilet seat of a toilet when not in use, the toilet including a bowl having an upper rim, the bowl of the toilet including a horizontal mounting surface behind the upper rim for attachment of the toilet seat, and the toilet seat including a bottom surface, the toilet seat lifter comprising in combination:

a. a base having a bottom surface adapted to rest upon the horizontal mounting surface of the bowl;

b. a threaded shaft extending downwardly from the bottom surface of the base for extending through a hole formed in the horizontal mounting surface of the bowl to secure the base to the horizontal mounting surface of the bowl;

c. a cylindrical body supported in fixed relationship to the base, the cylindrical body extending about a central longitudinal axis between first and second ends thereof, the central longitudinal axis extending substantially horizontally when the base is secured to the horizontal mounting surface of the bowl;

d. a hinge pin extending from the first end of the cylindrical body generally along the central longitudinal axis thereof for pivotally supporting the toilet seat relative to the horizontal mounting surface of the bowl; and e. a helical torsion spring having first and second ends, the torsion spring extending around, and being supported by, the cylindrical body, the first end of the torsion spring engaging the base, and the second end of the torsion spring being adapted to engage the bottom surface of the toilet seat;

whereby the torsion spring biases the toilet seat upwardly away from the bowl until a user pushes the toilet seat downwardly against the rim of the bowl.

2. The toilet seat lifter recited by claim 1 further including a nut for engaging the threaded shaft below the horizontal mounting surface of the bowl.

3. The toilet seat lifter recited by claim 1 wherein the second end of the cylindrical body is rigidly secured to the base.

4. The toilet seat lifter recited by claim 3 wherein the base and the cylindrical body are integrally formed from a single portion of plastic material.

5. The toilet seat lifter recited by claim 4 wherein the threaded shaft is threadedly engaged with a tapped bore extending into the base from the bottom surface thereof, and wherein the hinge pin is press-fit into a bore formed within the first end of the cylindrical body generally along the central longitudinal axis thereof.

6. The toilet seat lifter recited by claim 4 wherein the base is molded about an end of the threaded shaft, and wherein the cylindrical body is molded about an end of the hinge pin.

7. The toilet seat lifter recited by claim 1 wherein the base includes a generally-flattened plateau extending above and generally parallel to the bottom surface of the base, and wherein the first end of the torsion spring engages the generally-flattened plateau of the base.

8. A toilet seat lifter for raising a toilet seat of a toilet when not in use, the toilet including a bowl having an upper rim, the bowl of the toilet including a horizontal mounting surface behind the upper rim for attachment of the toilet seat, and the toilet seat including a bottom surface, the toilet seat lifter comprising in combination:

a. a base having a bottom surface adapted to rest upon the horizontal mounting surface of the bowl, wherein the base includes a generally-flattened plateau extending above and generally parallel to the bottom surface of the base;

b. a threaded shaft extending downwardly from the bottom surface of the base for extending through a hole formed in the horizontal mounting surface of the bowl to secure the base to the horizontal mounting surface of the bowl;

c. a cylindrical body supported in fixed relationship to the base, the cylindrical body extending about a central longitudinal axis between first and second ends thereof, the central longitudinal axis extending substantially horizontally when the base is secured to the horizontal mounting surface of the bowl wherein the cylindrical body extends above the generally-flattened plateau of the base;

d. a hinge pin extending from the first end of the cylindrical body generally along the central longitudinal axis thereof for pivotally supporting the toilet seat relative to the horizontal mounting surface of the bowl; and e. a helical torsion spring having first and second ends, the torsion spring extending around, and being supported by, the cylindrical body, the first end of the torsion spring engaging the generally-flattened plateau of the base, and the second end of the torsion spring being adapted to engage the bottom surface of the toilet seat;

f. the cylindrical body being spaced apart from the generally-flattened plateau of the base for allowing the torsion spring to slide over the cylindrical body from the first end thereof;

whereby the torsion spring biases the toilet seat upwardly away from the bowl until a user pushes the toilet seat downwardly against the rim of the bowl.

9. A self-lifting toilet seat assembly for a toilet for raising the toilet seat when a user is not sitting upon the toilet seat, the toilet including a bowl having an upper rim, the bowl of the toilet including a horizontal mounting surface behind the upper rim for attachment of a toilet seat, the self-lifting toilet seat assembly comprising in combination:

a. a toilet seat having at least a rear portion for being pivotally secured to the horizontal mounting surface of the bowl of the toilet, the rear portion of the toilet seat including first and second opposing bores formed therein for receiving first and second hinge pins, the toilet seat including a bottom surface which faces the upper rim of the bowl when the toilet seat is in use;

b. at least a first seat lifter for aiding in pivotally securing the toilet seat to the horizontal mounting surface of the bowl of the toilet, and for urging the toilet seat upwardly away from the upper rim of the toilet bowl, said first seat lifter including:

i. a base having a bottom surface adapted to rest upon the horizontal mounting surface of the bowl;

ii. a threaded shaft extending downwardly from the bottom surface of the base for extending through a hole formed in the horizontal mounting surface of the bowl to secure the base to the horizontal mounting surface of the bowl;

iii. a cylindrical body supported in fixed relationship to the base, the cylindrical body extending about a central longitudinal axis between first and second ends thereof, the central longitudinal axis extending substantially horizontally when the base is secured to the horizontal mounting surface of the bowl;

iv. a hinge pin extending from the first end of the cylindrical body generally along the central longitudinal axis thereof for extending within one of the first and second opposing bores formed in the rear portion of the toilet seat; and v. a helical torsion spring having first and second ends, the torsion spring extending around, and being supported by, the cylindrical body, the first end of the torsion spring engaging the base, and the second end of the torsion spring being adapted to engage the bottom surface of the toilet seat;

whereby the torsion spring of the first seat lifter biases the toilet seat upwardly away from the bowl until a user pushes the toilet seat downwardly against the rim of the bowl.

10. The self-lifting toilet seat assembly recited by claim 9 wherein said first seat lifter further includes a nut for engaging the threaded shaft below the horizontal mounting surface of the bowl.

11. The self-lifting toilet seat assembly recited by claim 9 wherein the second end of the cylindrical body of the first seat lifter is rigidly secured to its base.

12. The self-lifting toilet seat assembly recited by claim 11 wherein the base and the cylindrical body of said first seat lifter are integrally formed from a single portion of plastic material.

13. The toilet seat lifter recited by claim 12 wherein the threaded shaft is threadedly engaged with a tapped bore extending into the base from the bottom surface thereof, and wherein the hinge pin is press-fit into a bore formed within the first end of the cylindrical body generally along the central longitudinal axis thereof.

14. The toilet seat lifter recited by claim 12 wherein the base is molded about an end of the threaded shaft, and wherein the cylindrical body is molded about an end of the hinge pin.

15. The self-lifting toilet seat assembly recited by claim 9 wherein the base of said first seat lifter includes a generally-flattened plateau extending above and generally parallel to the bottom surface of the base, and wherein the first end of the torsion spring of said first seat lifter engages the generally-flattened plateau of its base.

16. A self-lifting toilet seat assembly for a toilet for raising the toilet seat when a user is not sitting upon the toilet seat, the toilet including a bowl having an upper rim, the bowl of the toilet including a horizontal mounting surface behind the upper rim for attachment of a toilet seat, the self-lifting toilet seat assembly comprising in combination:

a. a toilet seat having at least a rear portion for being pivotally secured to the horizontal mounting surface of the bowl of the toilet, the rear portion of the toilet seat including first and second opposing bores formed therein for receiving first and second hinge pins, the toilet seat including a bottom surface which faces the upper rim of the bowl when the toilet seat is in use;

b. at least a first seat lifter for aiding in pivotally securing the toilet seat to the horizontal mounting surface of the bowl of the toilet, and for urging the toilet seat upwardly away from the upper rim of the toilet bowl, said first seat lifter including:

i. a base having a bottom surface adapted to rest upon the horizontal mounting surface of the bowl, wherein the base includes a generally-flattened plateau extending above and generally parallel to the bottom surface of the base;

ii. a threaded shaft extending downwardly from the bottom surface of the base for extending through a hole formed in the horizontal mounting surface of the bowl to secure the base to the horizontal mounting surface of the bowl;

iii. a cylindrical body supported in fixed relationship to the base, the cylindrical body extending about a central longitudinal axis between first and second ends thereof, the central longitudinal axis extending substantially horizontally when the base is secured to the horizontal mounting surface of the bowl, wherein the cylindrical body extends above the generally-flattened plateau of it's the base;

iv. a hinge pin extending from the first end of the cylindrical body generally along the central longitudinal axis thereof for extending within one of the first and second opposing bores formed in the rear portion of the toilet seat; and v. a helical torsion spring having first and second ends, the torsion spring extending around, and being supported by, the cylindrical body, the first end of the torsion spring engaging the generally-flattened plateau of the base, and the second end of the torsion spring being adapted to engage the bottom surface of the toilet seat;

vi. the cylindrical body being spaced apart from the generally-flattened plateau of the base for allowing the torsion spring to slide over the cylindrical body from the first end thereof;

whereby the torsion spring of the first seat lifter biases the toilet seat upwardly away from the bowl until a user pushes the toilet seat downwardly against the rim of the bowl.

17. The self-lifting toilet seat assembly recited by claim 9 and further including a second seat lifter for aiding in pivotally securing the toilet seat to the horizontal mounting surface of the bowl of the toilet, and for urging the toilet seat upwardly away from the upper rim of the toilet bowl, said second seat lifter including:

i. a base having a bottom surface adapted to rest upon the horizontal mounting surface of the bowl;

ii. a threaded shaft extending downwardly from the bottom surface of the base for extending through a hole formed in the horizontal mounting surface of the bowl to secure the base to the horizontal mounting surface of the bowl;

iii. a cylindrical body supported in fixed relationship to the base, the cylindrical body extending about a central longitudinal axis between first and second ends thereof, the central longitudinal axis extending substantially horizontally when the base is secured to the horizontal mounting surface of the bowl;

iv. a hinge pin extending from the first end of the cylindrical body generally along the central longitudinal axis thereof for extending within one of the first and second opposing bores formed in the rear portion of the toilet seat; and v. a helical torsion spring having first and second ends, the torsion spring extending around, and being supported by, the cylindrical body, the first end of the torsion spring engaging the base, and the second end of the torsion spring being adapted to engage the bottom surface of the toilet seat;

whereby the torsion spring of the second seat lifter biases the toilet seat upwardly away from the bowl until a user pushes the toilet seat downwardly against the rim of the bowl.

* * * * *